United States Patent [19]

Lukos

[11] Patent Number: 4,463,792

[45] Date of Patent: Aug. 7, 1984

[54] APPARATUS FOR INSULATING A SURFACE AREA

[76] Inventor: Simon F. Lukos, 562 Hamilton Ave., Watertown, Conn. 06795

[21] Appl. No.: 410,031

[22] Filed: Aug. 20, 1982

[51] Int. Cl.[3] ..... E06B 9/08

[52] U.S. Cl. ..... 160/271; 160/DIG. 7; 160/120

[58] Field of Search ..... 160/269-273, 160/290, 120, 319, DIG. 7, 121, 122; 248/251-267

[56] References Cited

U.S. PATENT DOCUMENTS

| | | | |
|---|---|---|---|
| 768,416 | 8/1904 | Woods | 160/269 |
| 1,383,975 | 7/1921 | Booth | 248/254 |
| 1,497,320 | 6/1924 | Basilio | 248/259 |
| 1,716,285 | 6/1929 | Szako | 160/271 |
| 1,911,232 | 5/1933 | Large | 162/290 R |
| 2,253,584 | 8/1941 | Robinson | 248/252 |
| 2,809,798 | 10/1957 | Kenney | 248/263 |
| 4,126,174 | 11/1978 | Moriarity et al. | 160/271 |
| 4,231,411 | 11/1980 | Hehl et al. | 160/120 |
| 4,359,079 | 11/1982 | Bledcae | 160/269 |
| 4,399,855 | 8/1983 | Volfron | 160/271 |

FOREIGN PATENT DOCUMENTS

| | | | |
|---|---|---|---|
| 2841966 | 4/1979 | Fed. Rep. of Germany | 160/271 |
| 535806 | 4/1941 | United Kingdom | 160/271 |

*Primary Examiner*—Peter M. Caun

*Attorney, Agent, or Firm*—Frank J. Thompson

[57] ABSTRACT

An apparatus for insulating a surface area is disclosed having an insulating sheet mounted to a roller for winding and unwinding thereon. Sealing means are provided for sealing the edges of the sheet when the sheet is unwound to insulate the surface area.

13 Claims, 16 Drawing Figures

Fig. 2.
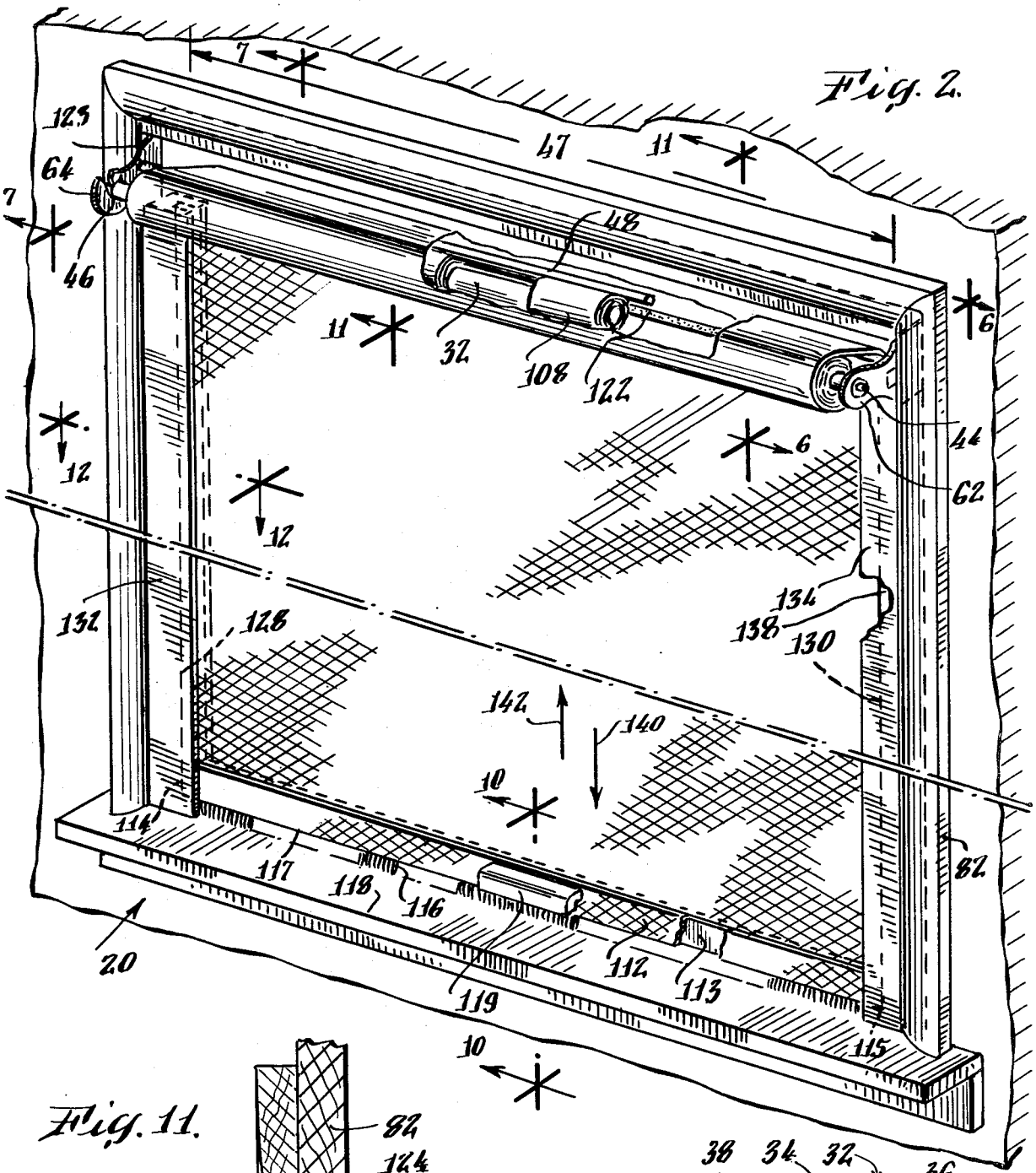
Fig. 11.
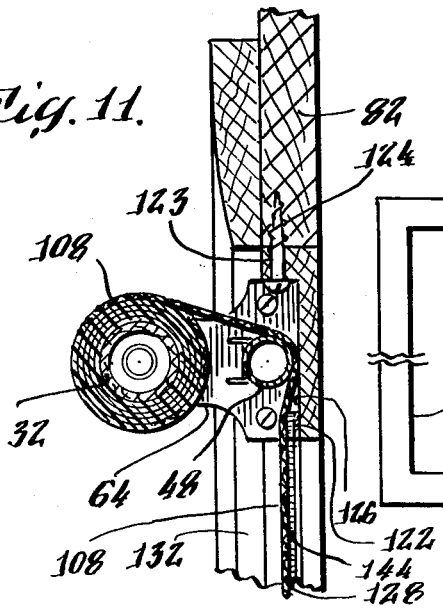
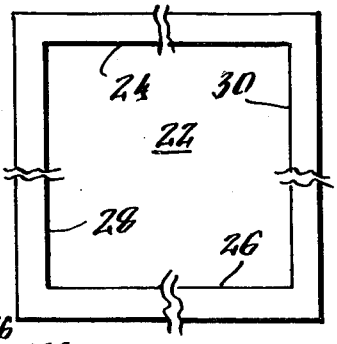
Fig. 1.
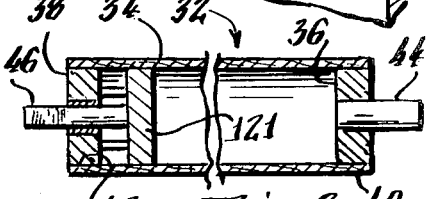
Fig. 3.
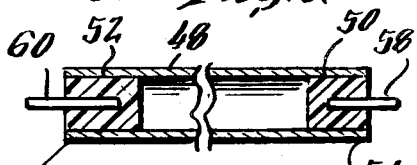
Fig. 4.

APPARATUS FOR INSULATING A SURFACE AREA

BACKGROUND OF THE INVENTION

1. Field of the Invention

This invention relates to insulating apparatus for reducing the flow of heat through a surface area. The invention relates more particularly to an improved apparatus for insulating and sealing surface areas through which there is a substantial heat loss.

2. Description of the Prior Art

Substantial heat can flow through various surface areas of structures. This is particularly true with exterior walls having glazed areas such as are normally found with windows and doors. The heat flow can be substantial even when a double glazed thermal-pane type of apparatus is utilized. An undesired flow of heat can also occur through and around various interior wall surfaces as a result of interior air currents. The net result is a loss of thermal energy from a heated structure, an increased loading on cooling equipment for an air-conditioned structure and an undesirable flow of interior currents which can be cool in winter and warm in summer. In view of present day energy costs, it is of course desirable to reduce the flow of heat through such areas. A relatively simple placement of insulating material adjacent the surface of relatively high heat transfer areas is generally insufficient since draft currents flow about the insulating material. While, the effectiveness of such simply placed insulation can be enhanced by sealing the area against draft currents, nonetheless many such surfaces to be insulated, such as windows and glazed doors, require access for viewing and cleaning. A sealed, permanent installation of insulating material would be unacceptable. Moreover, it is also desirable at times for shading and privacy purposes to only partially shade the area to be insulated and a permanently sealed insulation would not satisfy this need.

Other limitations and interferences can also hinder a placement of insulating material. For example, the dimensions of the framework of a glazed area may be susceptible to placement of an insulating arrangement within the framework but not on its exterior surfaces, or, vice versa, and specialized installations may be required for each alternative. Furthermore, glazed areas generally have decorative treatments utilizing curtains and valances and these can interfere with the placement of insulating materials which could effectively insulate and seal the glazed area.

Prior arrangements which have attempted to effect the insulation of such areas while satisfying one or more of the foregoing needs have failed in some respects in that they have not fully sealed the area to be heated; they have been relatively complex, expensive, unreliable and limited in adaptability for positioning within and without the windowframe; and they have been incompatible with existing window treatments.

SUMMARY OF THE INVENTION

Accordingly, it is an object of this invention to provide an improved apparatus for reducing the heat flow through a surface area.

Another object of the invention is to provide an improved insulating apparatus which seals and insulates a surface area while readily providing access to the area.

Another object of the invention is to provide an improved insulating apparatus for a glazed area which insulates the area, seals the area against draft currents, permits access to the area for cleaning, and provides for partial retraction of the insulation to enable partial shading and privacy viewing.

Another object of the invention is to provide a relatively noncomplex, relatively inexpensive and relatively easily installed apparatus for insulating a glazed area.

Another object of the invention is to provide an improved insulating apparatus for a glazed area which is adapted to be mounted within or on an outer surface of a framework of the area and which is compatible with existing decorative treatment of the area.

Another object of the invention is to provide an improved apparatus for insulating and sealing a glazed area against draft currents and which is restrained in a closed or partially closed attitude without the need for retaining locks or clips.

A further object of the invention is to provide an improved insulating apparatus for a glazed area having improved means for supporting a sheet support body and guide roller.

Still another object of the invention is to provide an improved bracket suport means for use with an insulating apparatus for sealing a glazed area.

In accordance with features of the apparatus of this invention for insulating a surface area and reducing draft currents, there is provided an elongated support roller, an elongated sheet guide body, and a bracket means for supporting the roller and guide body in spaced apart relationship at a location adjacent a first side of an area to be insulated. A flexible sheet of thermally-insulating material is mounted on the roller for unwinding and winding therefrom. First and second sheet edge guide means are positioned and mounted at opposite sides of the area. The sheet extends from the support roller to the guide body in surface engagement therewith and to first and second guide means. First and second edges of the sheet are positioned in the sheet edge guide means for sliding motion therein and for inhibiting air current flow past these edges. A spring means is provided for establishing a rotary force on the support roller for causing rotation and a winding of the sheet on the support roller. The sheet edge guide means establishes a frictional, restraining force on the sheet edges. The frictional force provided by the guide means at the edges of the sheet counteracts the winding, rotary force applied to the sheet by the roller and restrains the sheet at its last placed position. The sheet is unwound from the support roller by applying a manual force in a first direction to advance the sheet in the sheet edge guide bodies. A manual force applied to the sheet in a second opposite direction, in cooperation with the force applied by the spring means, overcomes the frictional resistance and causes rewinding of the sheet.

In accordance with more particular features of the invention, a sealing strip is positioned adjacent the first side of the area and the guide roller causes the sheet to engage this sealing strip. The bracket means are adapted to support both the support roller and the guide roller and to mount these alternatively within a frame of a glazed area or on an outer surface of the frame.

BRIEF DESCRIPTION OF THE DRAWINGS

These and other objects and features of the invention will become apparent with reference to the following specification and to the drawings wherein:

FIG. 1 is a schematic representation of a surface area to be insulated;

FIG. 2 is a fragmentary, perspective, partly cut away view of an insulating apparatus illustrating an embodiment of this invention;

FIG. 4 is an elevation view, in section, of a guide body used with the apparatus of FIG. 2;

FIG. 8 is an enlarged, right hand side view of the bracket of FIG. 7;

FIG. 11 is an enlarged view taken along line 11—11 of FIG. 2;

DETAILED DESCRIPTION

Figure 10:
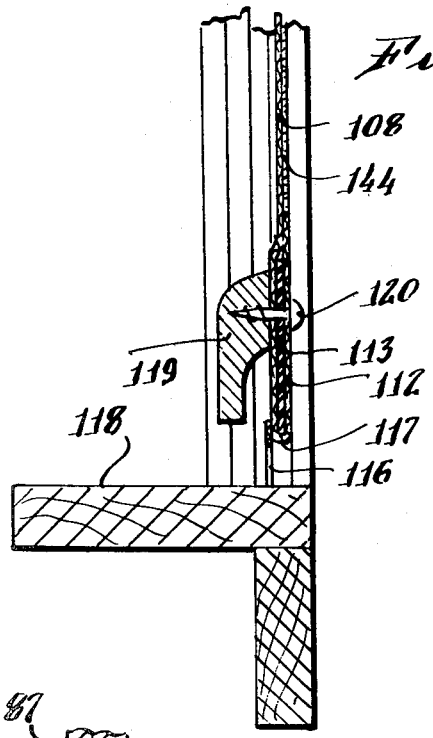
FIG. 10 is an enlarged view taken along line 10—10 of FIG. 2.

Referring now to the drawings, an apparatus 20 (FIG. 2) is provided for selectively adjusting thermal insulation over a surface area. The surface area to be insulated is represented schematically in FIG. 1 and is indicated by reference number 22. The area 22 has first and second opposite sides 24 and 26, respectively, and third and fourth opposite sides, 28 and 30 respectively. While the surface area 22 to be insulated typically comprises an exterior glazed area, such as a window, a glazed door, sliding glass doors, etc., it can comprise other surfaces, exterior and interior, through which it is desired to reduce heat flow and inhibit drafts. The apparatus includes an elongated support roller 32 (FIG. 2) which is formed by a tubular body 34 (FIG. 3). The tubular body 34 may be fabricated of wood, metal, polymer plastic or other suitable material. Caps 36 and 38 are positioned at opposite ends 40 and 42 of the tubular body 34, respectively. The cap 36 includes a dowel pin 44 which is press-fitted therein for rotatably mounting the end 40 as indicated hereinafter. A flattened pin 46 extends through the cap 38 for supporting the end 42. As indicated hereinafter, the pin 46 is spring loaded and when maintained stationary, the cap and roller rotate about it. The length 47 of the support roller 32 (FIG. 2) is coextensive with the length of the first side 24 of the area 22.

An elongated guide body 48 (FIG. 2) is provided and preferably comprises a guide roller which as shown in FIG. 4 is preferably tubular shaped and formed of a metal. Alternatively, the guide body can comprise a rod and can be fabricated of wood, polymer plastic or other suitable material. Molded plugs 50 and 52 which are formed of a polymer plastic are provided and are positioned and press-fitted in opposite ends 54 and 56, respectively, of the guide body 48. Dowel pins 58 and 60 are encapsulated in the plugs 50 and 52, respectively, for supporting the guide body for rotation. Guide body 48 may alternatively comprise a stationary body which does not rotate. The length of the guide body 48 is preferably coextensive in length with the length of the first side 24 of the area 22.

Figure 5:
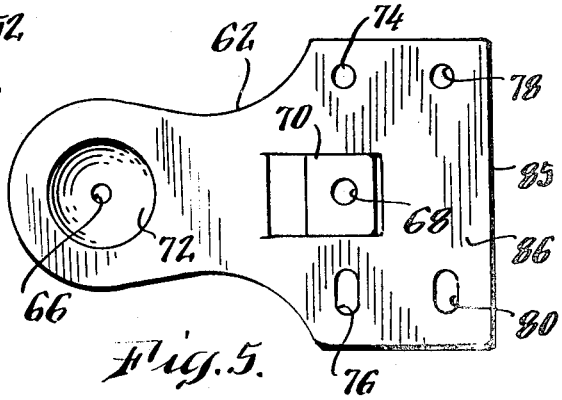
FIG. 5 is an enlarged, right hand side elevation view of a bracket used with the apparatus of FIG. 2.

A means for supporting the roller 32 and the guide body 48 in spaced apart relationship adjacent the first side 24 of the area 22 is provided. This means comprises first and second bracket means 62 and 64, respectively. Bracket 62 (FIG. 5), which is formed of a metal, includes apertures 66 and 68 formed therein for engaging and rotatably supporting pins 44 and 58 of the support roller 32 and guide body 48, respectively. Aperture 68 is formed in a segment 70 which is pierced on three sides and is deflected from a general plane of the bracket. This deflection provides space to receive and support the pin 58 of the guide body 48 when the bracket 62 is mounted flush against a surface. Aperture 66 which receives pin 44 of the support roller 32 is formed in a raised, disc-shaped, surface 72 for a similar reason. Mounting apertures 74, 76, 78 and 80 are formed in the bracket 62 for receiving mounting hardware such as screws for mounting the bracket to a windowframe 82 (FIG. 2), doorframe, or other frame or structure which extends about the area 22 to be insulated. Apertures 78 and 80 are formed near an edge segment 85 which is bent to form a mounting flange 86.

Figure 6:
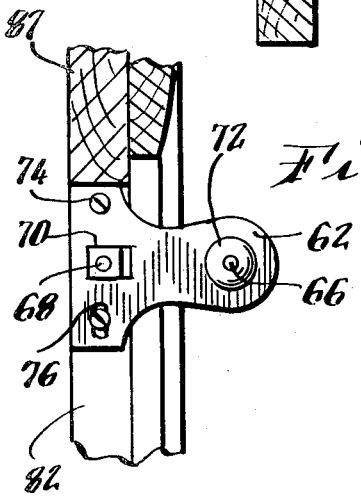
FIG. 6 is an enlarged view taken along line 6—6 of FIG. 2 illustrating the bracket of FIG. 5 in mounted position.
Figure 14:
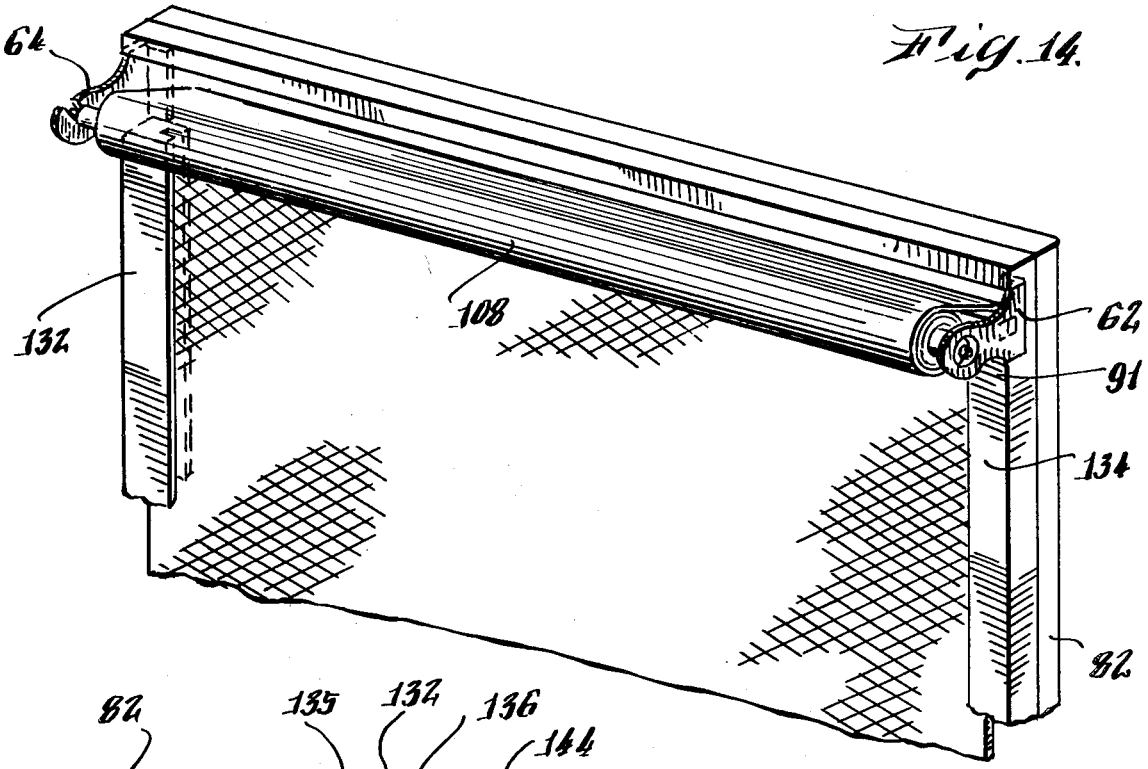
FIG. 14 is a fragmentary, perspective view of an alternative embodiment of the insulating apparatus of this invention.
Figure 12:
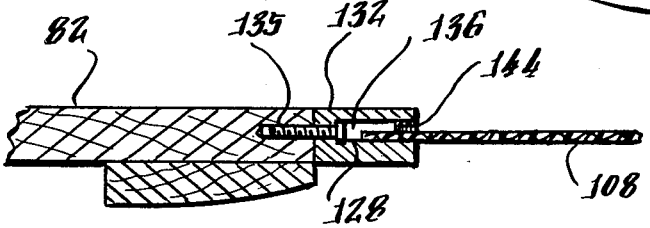
FIG. 12 is an enlarged view taken along line 12—12 of FIG. 2.

The bracket 62 is adapted to be mounted within the framework of the area being insulated on an inner surface of the frame, as for example within the windowframe 82 as illustrated in FIG. 2 and 6. Alternatively, it is adapted to be mounted on an outer surface of the framework as illustrated in FIG. 14. Inside mounting is effected by positioning the bracket flush with an inside surface 87 of the frame 82 (FIG. 6) and securing mounting screws to the frame through the apertures 74 and 76. Outside mounting is effected by positioning the flanged bracket segment 86 flush with the outside frame surface (FIG. 14) and securing mounting hardware to the frame through apertures 78 and 80.

Figure 9:
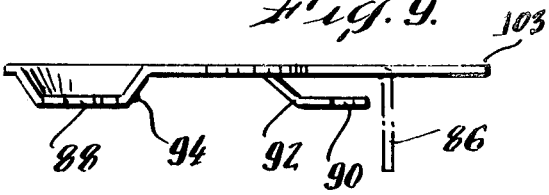
FIG. 9 is a plan view of the bracket of FIG. 8.
Figure 8:
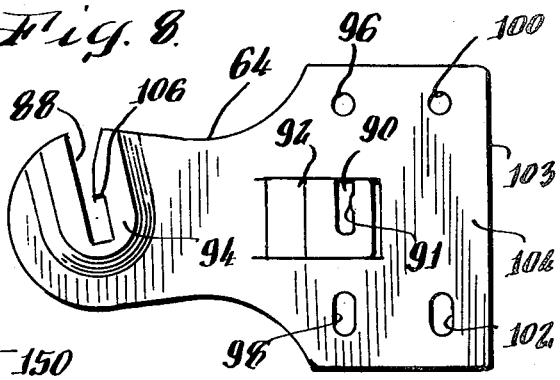
FIG. 8 is an elevation view, in section, of a support roller used with the apparatus of FIG. 2.

Bracket 64 which is similarly formed of metal includes slotted apertures 88 and 90 (FIGS. 8 and 9) for engaging and supporting pins 46 and 60 of the support roller 32 and guide body 48, respectively. Aperture 90 is formed in a segment 92 which is pierced and deflected slightly from the plane of the bracket for the reasons given above with respect to bracket 62. The slotted aperture 88 is also formed in a raised, disc-shaped surface segment 94 for the same reasons. Mounting apertures 96 and 98 are provided for an inside frame mounting while mounting apertures 100 and 102 are formed near an edge 103 in a flanged segment 104 for an outside mounting as described above with respect to the bracket 62. It is noted that the flanged segments 104 and 86 are sheared from the body for inside mounting as shown in the Figures. Alternatively, where clearance is available, these flanges can remain on the bracket for an inside mounting. The slotted aperture 90 enables rotary mounting of the guide body 48. Pin 58 located at the end 54 of the guide body 48 is initially placed in aperture 68 of bracket 62. Pin 60 of the guide body is then placed from the open end of the slot 90 into the slot. Guide body 48 is thereby rotatably mounted. A reentrant segment 91 in slot 90 inhibits unwanted escape of the pin during operation. Support roller 32 is similarly mounted by initially placing pin 44 located at end 40 of tubular body 34 into the aperture 66 of bracket 62. Flattened pin 46 located at the other end of body 34 is then placed from the open end of the slot 88 into the slot. The generally rectangular configuration of the slot 88 inhibits rotation of the flattened pin 46 therein and a reentrant segment 106 inhibits escape of the pin 46 from the slot 88. As indicated hereinafter, pin 46 is removed from the bracket 64 by rotating the pin slightly in a clockwise direction as viewed in FIG. 13 and opposite to the extension of reentrant segment 106 thereby enabling it to be raised in the slot past this segment and to be removed from the bracket.

Figure 16:
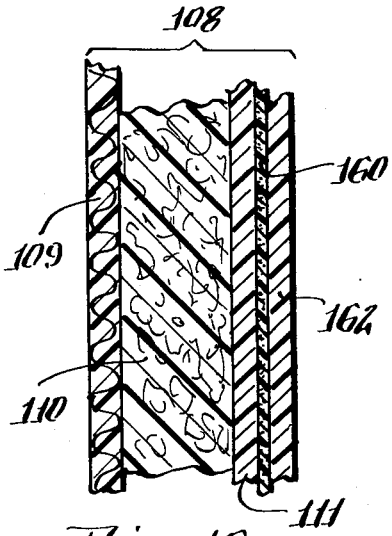
Figure 7:
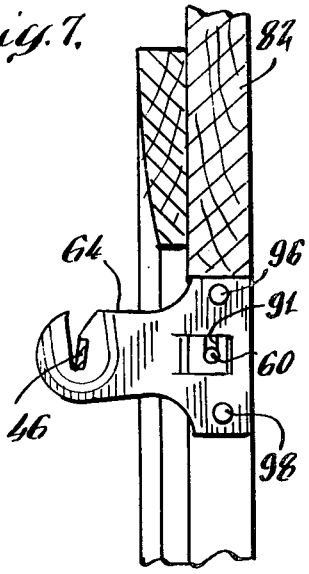
FIG. 7 is an enlarged view taken along line 7—7 of FIG. 2.

A sheet 108 of flexible, thermally-insulating material is mounted to the support roller 32 for winding on and unwinding therefrom. The sheet 108 is preferably formed of a plurality of quilted layers of flexible, thermally-insulating materials, as best illustrated in FIGS. 10 and 16. In FIG. 16 the sheet 108 is shown to have five layers. A room side layer 109 is formed of a polyester drapery fabric, for example FORTREL. A layer 110 comprises a batting of polyurethane insulating foam such as CURON. A middle layer 111, formed of a polyester film such as MELINEX, creates a vapor barrier to limit condensation. The layer 160 is formed of a metallized polyester film for reflecting interior heat into the room. Layer 162 is formed of a white acrylic material for reflecting exterior sunlight and heat. These layers of sheet 108 are laminated and bound tightly together in a decorative, quilted pattern by heating or ultrasonic bonding. Sheet 108 has a length which is at least coextensive with the length of the opposite third and fourth sides 28, 30 of the area 22, and, has a width which is coextensive with the length of the first and second opposite sides 24, 26, respectively, of the area 22. The sheet is secured along its edge at one end to the support roller body 34 by taping, by stapling when the roller 32 is formed of wood or of a polymer plastic, by an adhesive or by any other suitable means. A hem 112 is formed at an opposite end of the sheet and a draw strip 113 of a relatively rigid material is positioned in the hem. Draw strip 113 which has opposite ends 114 and 115 thereof is formed of a polymer plastic, or a thin strip of hardwood, or any other suitable material which is relatively rigid with respect to the flexible sheet material. A dense cotton fringe 116 is mounted to a leading edge 117 of the sheet by a suitable adhesive. This fringe seals the leading edge to a lower surface 118 of the frame 82 along the second side of the area 22 which is shown to be a window sill. The sheet 108 is manually gripped adjacent a leading edge by a wood hand grip 119 which is mounted to the draw strip 113 by a screw 120.

A means for establishing a rotary force on the support roller 32 is provided for causing a winding rotation of the sheet 108 on the roller 32. This means is provided by a spring 121 (FIG. 3) which is positioned within the tubular body 34 near the end 42. The spring means 121 is mechanically coupled to the body 34 through the cap 38 and to the flattened pin 46. This coupling operates, when the pin 46 is held stationary in slot 88 of bracket 64, to apply a rotary force through the cap 38 to the tubular rotary body 32 in a known manner. It is noted, however, that a locking means is not provided in the roller 32 for inhibiting rotation of the roller 32 when the rotary force is so applied. A restraint which is applied to the roller 32 is discussed hereinafter.

An elongated sealing strip 122 which is coextensive in length with the first side 24 of the area 22 is positioned adjacent the first side in order to inhibit air currents or drafts which might otherwise bypass the sheet 108 at this location. This strip is formed of a synthetic felt material having soft, dense, resilient, pile and is sold commercially under the tradename SCHLAEGEL wool. Other strip materials such as felt can also be used. A means for supporting this strip 122 adjacent the first side is provided and comprises an elongated headboard 123. The headboard 123 is preferably formed of wood; it is mounted to the frame 82 by screws 124 (FIG. 11); and it is adapted to be stained or painted in order to conform to the finish of the frame 82. Alternatively, the headboard can be fabricated of other suitable materials which have been surface finished or treated in order to match the finish of the frame 82. The sealing strip 122 also extends in a direction normal to a surface 126 of the headboard 123 and is secured to this surface by a suitable adhesive.

The brackets 62 and 64 support and position the guide body 48 as shown in FIG. 11 in parallel relationship with the strip 122 and at a vertically elevated position with respect to the strip for causing the sheet 108 to slightly pinch surface 126 and to then engage the sealing strip 122 and provide a draft seal. This positioning also provides a path of travel for entry of the sheet to and exit from a sheet edge guide means, described hereinafter. The entry and exit of the sheet is from above the sheet edge guide means at an angle which advantageously avoids dragging, binding and tearing of the sheet at the point of entry to, and, exit from the sheet guide means.

A means is provided for guiding opposite edges 128 and 130 of the sheet 108, for inhibiting air currents or drafts which might otherwise flow and bypass sheet 108 at the edges, and for counteracting the rotary force which is applied to the support roller 32 by the spring means 121. This means comprises first and second elongated guide bodies shown to be strips 132 and 134, respectively which are positioned and mounted to the frame 82 adjacent the third and fourth sides 28 and 30, respectively, of the area 22. The guide strips are preferably formed of wood and are adapted to be stained or painted in order to conform with the finish of the frame 82 positioned about the area 22. A screw means 135 secures the strips to the frame 82. Alternatively, the guide strips can be fabricated of other materials and the surface perpared to match the finish of the frame 82. The guide strips 132 and 134 each has formed therein an elongated channel or groove 136 and 138, respectively, in which the edges 128 and 130 of the sheet 108 travel. The end segments 114 and 115 of the draw strip 113 are also positioned in the grooves 136 and 138, respectively. An elongated sealing strip 144 is positioned in the groove 136 along the length of the guide strip and effects a seal against air currents and drafts which might otherwise flow around the edge 128. A similar strip, not shown, is also positioned in the groove of guide strip 134 sealing the edge 130 against air currents. The surface contact between these sealing strips and the inner surfaces of the strip with the sheet edges 128, 130, respectively, establish a frictional force which counteracts the rotary force applied to the roller body 32 by the spring 121. These sealing strips are formed of the same material as the sealing strip 122 and are secured by a suitable adhesive.

As shown in FIG. 11, sheet 108 extends from the roller 32 to the guide body 48 and, between the guide body 48 and strip 122 to the guide strips 132 and 134. The sheet edges 128 and 130 are, as indicated above, positioned in the associated channels for sliding motion therein. The application of a manual force to the hand grip 119 in a first direction as indicated by the arrow 140 shown in FIG. 2 will cause descent of the sheet 108 with its edges 128 and 130 travelling in the guides 132 and 134, respectively. Upon removal of the hand force, the sheet 108 will remain at its advanced position. The sheet is restrained at this advanced position by friction forces established between the sheet edges 128 and 130 and the sheet edge guide channels. Upon the application of a manual force to the handgrip in a second opposite direction as indicated by arrow 142 in FIG. 2, the force established by the guide means on the sheet which counteracts the rotary force applied to the roller 32 is overcome and the spring force applied to the roller, in addition to the manually applied force, will cause the sheet to ascend. The sheet will be restrained at that location at which the manual force is removed.

Figure 13:
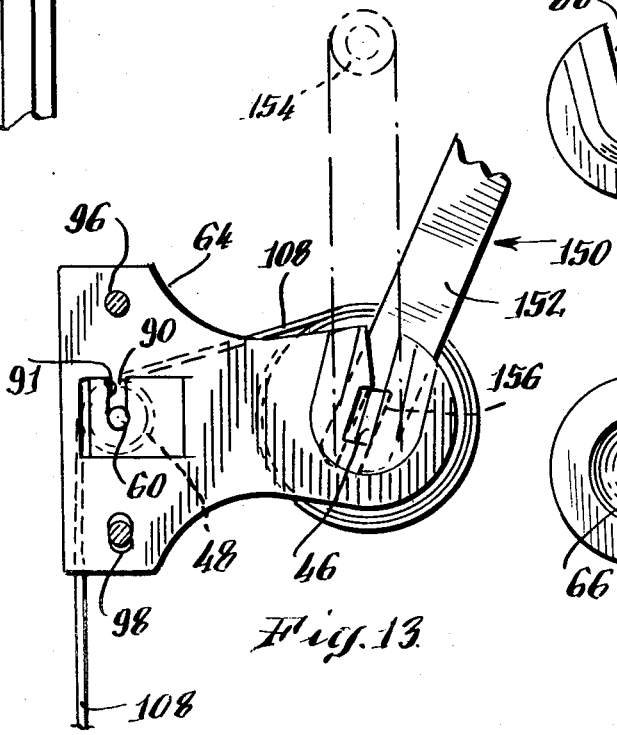
FIG. 13 is a left hand side view of the bracket of FIG. 8 in mounted position and illustrating alternative positions of a crank arm which is coupled to a spring winding pin of a support roller used with the arrangement of FIG. 2.

Release of the guide roller pin 46 from the bracket slot 88, and, winding of the spring 121 to establish a spring force on the roller 32 at a magnitude which is slightly less than the counteracting force provided by the guide bodies 132 and 134 is accomplished by the use of a hand crank. As shown in FIG. 13, a hand crank 150 includes an arm 152 and an extending crank handle 154. The arm 152 includes a slot 156 formed at one end thereof. Removal of the pin 46 is accomplished by advancing the slot 156 about the pin 46 at a location between the bracket 64 and cap 38 of the roller 32, and then rotating the pin 46 in the slot 88 until it clears the reentrant segment 106. The pin can then be raised and removed from the slot 88. When so removed, the pin 46 can be wound to establish a spring force which is slightly less than the counteracting force provided by the guide means on the sheet. This is simply determined by initially winding the spring a number of turns and replacing the pin 46 in the slot 88. Should the sheet 108 ascend without the application of a manual force to the hand grip 119, the spring is applying an excessive force. The pin 46 is then removed and the spring 121 is unwound slightly until a winding tension of the spring is found at which ascent of the sheet does not occur. If the manual force applied to the hand grip 119 fails to raise the sheet, then the spring 121 is wound to an insufficient tension and the winding should be increased as indicated until a greater force is applied to the sheet.

Figure 15:
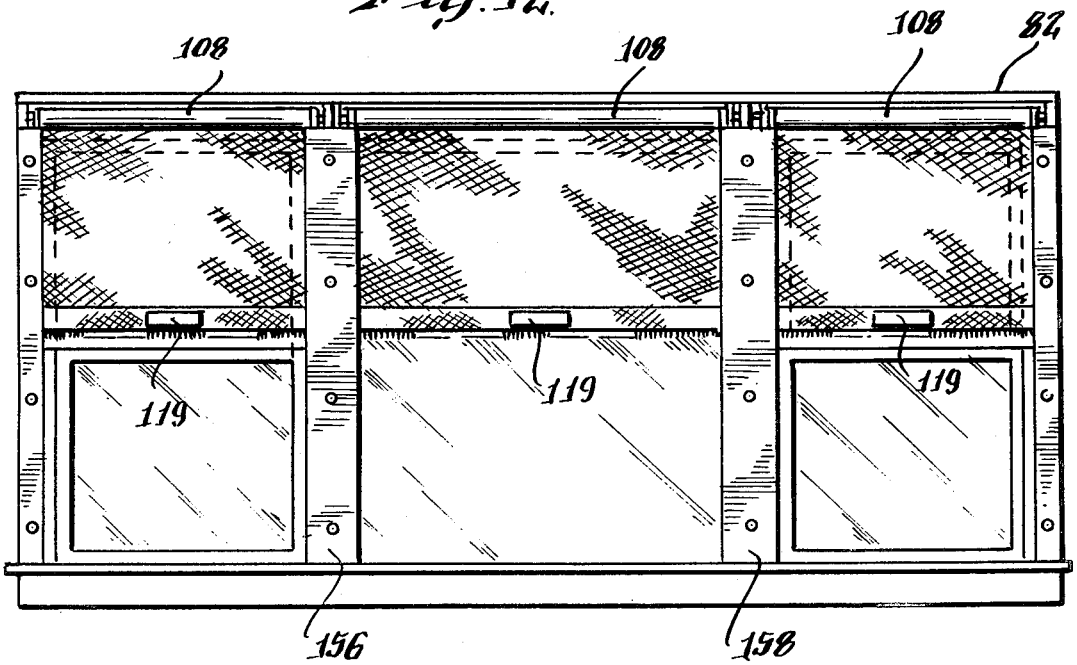
FIG. 15 is a front elevation view of a window array and illustrating the use of multiple insulating apparatus of this invention with a mullion window arrangement; and, FIG. 16 is an enlarged, fragmentary, sectional view of an insulating sheet used with the apparatus of the present invention.

FIG. 15 illustrates an assembly of the above described apparatus which are arranged to insulate mullion windows. In this case, three such apparatus are utilized. The apparatus are in all respects similar and are arranged for mounting on an outer surface of the frame 82. Central rails 156 and 158, however, each include sheet edge guide channels and insulating strips at each edge thereof.

The apparatus thus described advantageously insulates surface areas and seals against and inhibits air currents about the insulating sheet. A relatively noncomplex apparatus having a relatively few number of parts is provided which enhances the reliability of the apparatus, facilitates the installation and reduces the cost. The apparatus is adaptable for inside frame and outside frame installations and is compatible with existing decorative treatments for windows and doors. When fabricated of wood, it is readily stained or painted to conform with the existing frame finish. The apparatus further provides for positioning the insulating sheet fully closed or partly open for shading and privacy viewing.

While there has been described herein particular embodiments of the invention, it will be apparent that variations may be made thereto without departing from the spirit of the invention and the scope of the appended claims.

What is claimed is:

1. An apparatus for selectively adjusting thermal insulation over the surface of an area, said area having first and second opposite sides and third and fourth opposite sides thereof, comprising:

a. an elongated support roller;

b. an elongated guide body;

c. bracket means for supporting both said roller and guide body in spaced apart relationship at a location adjacent the first side of said area;

d. an elongated flexible sheet of thermally-insulating material mounted to said roller for winding-on and unwinding from said roller;

e. said sheet having a width which is coextensive with said first and second sides of the area and a length which is coextensive with the third and fourth opposite sides of the area;

f. said sheet having first and second opposite edges thereof;

g. first and second sheet edge guide and sealing means positioned adjacent the third and fourth area sides, respectively;

h. said sheet edge guide and sealing means adapted to receive said sheet edges for sliding motion therein and to inhibit air current flow past sheet edges in said guide and sealing means;

i. said sheet extending from said support roller and about said guide body in engagement therewith and from said guide body to said first and second sheet guide means;

j. said first and second sheet edges positioned in said first and second sheet edge guide means, respectively;

k. a spring means for establishing a rotary force on said support roller for causing a winding motion thereof to cause winding of said sheet thereon; and, l. said sheet edge guide means establishing a frictional force on said sheet at said edges which counteracts said rotary force applied to said support roller by said spring means, m. whereby said sheet is unwound from said roller and is advanced in said sheet edge guide means by the application of a manual force in a first direction to said sheet, it is restrained at an advanced position by said sheet edge guide means upon release of said manual force and air current flow past said sheet is inhibited when said sheet is advanced to said second side of the area to be insulated, and said sheet is wound on said roller and is retracted by the application of a manual force in a second opposite direction to said sheet.

2. The apparatus of claim 1 including an elongated sealing strip, means for supporting said strip at a location adjacent the first side of the area, and said guide body support means positions said guide body in parallel relationship with said elongated sealing strip at a location for causing said sheet to engage said sealing strip along the width of said sheet.

3. The apparatus of claim 2 wherein said guide body is positioned at a vertical location above said elongated sealing strip.

4. The apparatus of claim 1 wherein said elongated guide body comprises a rotatably supported roller and said bracket support means comprises first and second spaced apart brackets which include apertures formed therein for receiving support pins of said support roller and said guide body.

5. The apparatus of claim 4 wherein said brackets are adapted to be alternatively mounted within a frame of the area to be insulated or on an outer frame surface of the area to be insulated.

6. The apparatus of claim 1 wherein said first and second sheet edge guide means has a channel formed therein in which said opposite edges of said sheet travel and a sealing strip is positioned in each said channel for engaging said sheet edges and inhibiting the flow of air currents about said edges in said channels.

7. The apparatus of claim 1 wherein said flexible sheet of thermally insulating material comprises a quilted plurality of layers of insulating material.

8. An apparatus for selectively adjusting thermal insulation over a surface area, said area having first and second opposite sides and third and fourth opposite sides thereof, comprising:

a. an elongated headboard which is coextensive in length with the first side of the area to be insulated;
b. an elongated strip of sealing material mounted to said headboard adjacent to the first side of the area;
c. an elongated support roller which is coextensive in length with the first side of the area to be insulated;
d. an elongated guide roller having a length which is coextensive in length with the length of the first side of said area to be insulated;
e. first and second bracket means positioned at opposite ends of said headboard for rotatably supporting said support and guide rollers in spaced apart relationship adjacent the first side of the area to be insulated;
f. said bracket means supporting said guide roller in parallel relationship with said sealing strip at a location for causing said sheet to engage said sealing strip;
g. an elongated, flexible sheet formed of a thermally insulating material and having first and second edges thereof;
h. said sheet mounted to said support roller for winding-on and unwinding from said roller when said roller is rotated in first and second opposite directions, respectively;
i. said sheet having a width which is coextensive in length with the first side of said area to be insulated and a length which is coextensive with the third and fourth sides of the area to be insulated, said sheet having first and second elongated edges and a leading edge thereof;
j. first and second elongated sheet edge guide and sealing bodies extending along the third and fourth sides of the area, respectively;
k. said first and second sheet edge guide bodies having channels formed therein for receiving and guiding said first and second sheet edges therein;
l. said channels each having sealing means positioned therein for inhibiting air current flow past said sheet edges positioned in said sheet edge guide bodies;
m. said sheet extending from said support roller and about said guide roller in engagement therewith and in engagement with said sealing strip, and, from said guide roller to said sheet edge guide bodies;
n. said first and second sheet edges positioned in said channels of said first and second sheet edge guide bodies respectively for sliding motion therein;
o. spring means for establishing a rotary winding force on said support roller for causing a winding motion thereof to cause winding of said sheet thereon; and,
p. said sheet edge guide bodies establishing a frictional force on said sheet at said edges which counteracts said rotary force applied to said roller by said spring means,
q. whereby said sheet is unwound and is advanced by the application of a manual force in a first direction to said sheet, said sheet is restrained at an advanced position upon the release of said manual force, air current flow past said sheet is inhibited when said sheet is fully advanced to the second side of the area to be insulated, and said sheet is retracted by the application of a manual force in a second opposite direction to said sheet.

9. The apparatus of claim 8 wherein said sheet has a leading edge and including a draw strip of material relatively more rigid than said flexible sheet and supported at said leading edge, said draw strip having opposite ends thereof which are positioned in said channels of said first and second sheet edge guide means, respectively.

10. The apparatus of claim 8 wherein said brackets include means for mounting said brackets within a framework of the area to be insulated, and, alternatively, on an outer surface of the framework of the area to be insulated.

11. The brackets of claim 10 wherein said bracket mounting means for mounting each bracket comprises a first pair of mounting apertures for mounting the bracket within the framework and a second alternative pair of mounting apertures for mounting said bracket on an outer surface of said framework.

12. The brackets of claim 11 wherein said second pair of mounting apertures are formed adjacent an edge segment of said bracket, said edge segment is flanged and said flanged segment includes said apertures for mounting said bracket on an outer surface of said framework.

13. The apparatus of claim 3 wherein said guide is vertically positioned above said sheet edge guide means and in alignment therewith for guiding the edges of said sheet to said sheet edge guide means.

* * * * *